US006139011A

United States Patent [19]

Huang et al.

[11] Patent Number: 6,139,011

[45] Date of Patent: Oct. 31, 2000

[54] JAM CLEARANCE FOR PRINTER PATH BY MANUAL OPERATION

[75] Inventors: Pui Wen Huang; Kok Sam Yip; Ching Yong Chua; Seng Lim Richard Wu, all of Singapore, Singapore

[73] Assignee: Hewlett-Packard Company, Palo Alto, Calif.

[21] Appl. No.: 09/165,021

[22] Filed: Oct. 2, 1998

[51] Int. Cl.[7] ..... B65H 5/02

[52] U.S. Cl. ..... 271/274; 271/273; 271/114; 271/902

[58] Field of Search ..... 271/902, 273, 271/274, 114; 400/636, 637, 636.3, 637.1

[56] References Cited

U.S. PATENT DOCUMENTS

| | | | |
|---|---|---|---|
| 3,682,550 | 8/1972 | Samuels et al. | 271/56 |
| 4,247,212 | 1/1981 | Wu | 400/556.2 |
| 4,529,188 | 7/1985 | Sturnick | 271/114 |
| 4,900,003 | 2/1990 | Hashimoto | 271/114 |
| 4,930,916 | 6/1990 | Fujiwara | 400/636 |
| 4,976,557 | 12/1990 | Uchikata | 400/565 |

*Primary Examiner*—Donald P. Walsh
*Assistant Examiner*—Daniel K Schlak

[57] ABSTRACT

A printer having a facility for manually directing a printing medium along a printing medium path. The printer includes an external housing, a drive roller arranged about an axis of rotation for feeding a printing medium through a processing zone of the printer, a control member arranged about an axis of rotation, and movable between a first axial position in which the control member protrudes from said external housing so as to be manually actuable, and a second axial position in which the control member is retracted relative to the first axial position, and a coupling mechanism selectively coupling the control member and the feed roller to translate rotational movement of the control member into rotational movement of the feed roller, said coupling mechanism being engaged when the control member is in the first axial position and disengaged when the control member is in the second axial position.

11 Claims, 15 Drawing Sheets

JAM CLEARANCE FOR PRINTER PATH BY MANUAL OPERATION

This invention relates to a printer having a facility for manually directing a printing medium along a printing medium path. In particular, the invention relates to a printer apparatus having an improved manual paper jam removing capability. In the context of this invention, the term printer is intended to include impact printers, laser printers, inkjet printers, copiers, fax machines and other relevant image forming machines employing printing medium paths.

BACKGROUND TO THE INVENTION

One type of image forming machine employing a printing medium path is a "sheet-feed" printer. In a known "sheet-feed" printer, sheets of paper or other printing media are pulled or picked from an input tray and fed downstream into the print engine components where the desired image is formed on each sheet. This operation is typically accomplished using a series of motor driven rollers that have frictionally adherent surfaces. The surface of the initial or pick roller rotates against the upper surface of the top sheet in the stack to direct the top sheet along a predetermined printing medium path. The sheet is advanced through an infeed zone and is received by a drive roller which supplies the sheet into a processing zone for printing. The sheet is then expelled through an output zone or tray. This cycle is repeated for each sheet to be printed. FIGS. 1*a* to 1*c* show a few of the components used in this type of printer.

A problem experienced with printers of this type is that the sheet being fed may become subject to a disturbance somewhere along the printing medium path. The disturbance is typically the result of a sheet having imperfections or becoming skewed in the infeed zone. Usually, the part of the sheet encountering the disturbance will be blocked, whilst the remaining part will continue its progression along the printing medium path by the action of the rollers. Accordingly, the sheet will build up against the blockage until the rollers operating in the direction of the blockage no longer adhere to the fed sheet. Consequently, the sheet will become "jammed" in the printer mechanism as illustrated, for example, in FIGS. 1*d* and 1*e*. This effect is known as a sheet or paper jam. Sheet or paper jams can also occur in the other types of printers referred to above which employ printing medium paths.

Although the frequency of paper jams in modern printers has generally decreased, when this problem does occur the result can have a damaging effect on the printer. The printer motor, for example, can over-heat as a result of the increased load on the rollers. Also, in printers using ink, the image forming components may deposit ink within the printer instead of on the printing medium. In order to reduce the damaging effects of paper jams, printers have been developed which can detect certain indicators of a paper jam so that the operations of the printer are ceased as soon as possible.

Once a paper jam has occurred the jammed paper will often end up concertinaed in some form next to the drive roller as illustrated in FIG. 1*d*. Removal of the paper to clear the jam may then be performed manually by grabbing one of the ends of the paper and pulling. However, this method is undesirable since the paper may rip or unnecessary strain may be placed on the motor as the drive roller is forced around too quickly.

A more suitable and commonly used method of removing a jammed sheet of paper is to manually rotate the drive roller to direct the paper along the printing medium path. This manual rotation may be enabled by a knob located outside the printer housing which is attached to the drive roller. The drive roller may be rotated either in a forwards direction to direct the jammed sheet towards the output zone or in a reverse direction to direct the jammed sheet towards the infeed zone. The choice of direction is arbitrary and both directions are generally attempted, on the basis of trial and error, until successful release of the jammed paper into one of the infeed or output zones.

A drawback with this method is that the manually operable knob located outside the printer housing rotates with the drive roller during normal operation of the printer. Any accidental contact made with the knob will disturb the line feeding of paper by the drive roller. This will result in displacement of the paper during the sensitive printing processing. Consequently, the printing quality will be affected, and particularly so in high resolution printers.

In an alternative system, a shaft is arranged on an axis parallel with the axis of the drive roller. The shaft supports a manually operable knob which is located outside the housing of the printer. When the knob is depressed in an axial direction of the shaft, a gear supported by the shaft engages with a gear attached to the drive roller. A user wishing to clear a paper jam simply pushes the exposed knob towards the body of the printer to engage the drive roller gear train, and turns the knob at the same time to direct the paper away from the drive roller. An advantage of this improved system is that the knob is not rotating while the printer is printing. Thus, accidental contact made with the knob is less likely to disturb the line feeding of paper which occurred in the existing solution.

However, when using the alternative system there is still a considerable risk that the knob will be accidentally pushed in, resulting in disturbance of the line feeding of paper. This is especially so, since in the unengaged position the knob is particularly exposed from the body of the printer.

Furthermore, due to the ergonomics of the alternative system, a user wishing to remove a paper jam will be required to perform repeated "pushes" and "turns" of the knob. This problem has been addressed in known systems by increasing the gear ratio of the gear train so that each turn of the knob will cause increased rotation of the drive roller. However, this fix solution is not ideal since fast turning of the knob will generate undue stress to the gear train and drive motor. Additionally, the frictional resistance of the system will increase so that turning of the knob will be harder for a user.

In certain printers such as the DeskJet 1100C, available from the Hewlett-Packard Company, USA, the pick roller is selectively coupled to the drive roller via a gear and clutch arrangement. A short reverse rotation of the drive roller causes the pick roller to engage with the drive roller for one rotation of the pick roller in order to pick one sheet of paper from the paper stack. Because during normal operation the drive roller only performs forward rotations, the short reverse rotation provides a convenient initiation of the sheet picking operation. However, when removing paper jams using the aforementioned manual systems, the drive roller will typically be reversed and further sheets will be picked from the sheet stack. This is undesirable since the newly fed sheets may compound the jamming problem by becoming jammed themselves. Moreover, these extra sheets will be wasted.

SUMMARY OF THE INVENTION

It is an object of the present invention to provide a printer which has a manually operable means for directing paper out of a jammed condition. The manually operable means is preferably engaged when it is moved to a retracted axial position. Therefore accidental disturbance of the printer line feed by contact or depression of the manually operable means is prevented.

According to a first aspect of the present invention there is provided a printer having a facility for manually directing a printing medium along a printing medium path, the printer comprising: an external housing; a drive roller arranged about an axis of rotation for feeding a printing medium through a processing zone of the printer; a control member arranged about an axis of rotation, and movable between a first axial position in which the control member protrudes from said external housing so as to be manually actuable, and a second axial position in which the control member is retracted relative to the first axial position; and a coupling mechanism selectively coupling the control member and the feed roller to translate rotational movement of the control member into rotational movement of the feed roller, said coupling mechanism being engaged when the control member is in the first axial position and disengaged when the control member is in the second axial position.

A printer in accordance with the first aspect of the present invention has an advantage that the coupling mechanism may only be engaged when the control member is moved to the first axial position. Thus, mere accidental contact with or depression of the control member when it is in the second axial position will not cause the coupling mechanism to engage. Consequently, there will be no disturbance of the printer's line feed when the printer is printing.

Ideally, the control member is biased towards the second axial position. This has the advantage that the control member will automatically return to the axial position in which the coupling mechanism is disengaged. The control member will only move to the first axial position when manually guided there. Accordingly, accidental disturbance of the printer's line feed is less likely to occur.

Suitably, the control member is substantially flush with the external housing in the second axial position. Since in general the control member is only required to be operated following a paper jam, having the control member flush with the printer housing has an advantage in helping minimise the dimensions of the printer. Furthermore, the control member is again less likely to move to the engaged position except when it is intentionally moved there manually.

The control member may comprise an axial shaft with a manually actuable knob at a distal end thereof. Preferably, the knob includes a hinge supporting a lever, which lever may be extended to aid movement of the control member from the second axial position to the first axial position, and to aid continuous manual rotation of the knob.

In a preferred embodiment, the printer further comprises: a picking mechanism selectively coupled to the drive roller, for picking individual sheets of media from a sheet media stack; and a linkage mechanism coupled to the shaft of the control member, such that when the control member is in the first axial position, the linkage mechanism engages with the picking mechanism to disable picking of further individual sheets. The linkage member may comprise a shaft arranged in parallel with the control member shaft, and a pivotally mounted lever attached to both the control member shaft and the linkage member shaft, the lever translating axial movement of the control member shaft in one direction into axial movement of the linkage mechanism shaft in an opposite direction, whereby movement of the control member to the first axial position causes movement of the linkage mechanism shaft in a direction so as to engage with the picking mechanism to disable further picking of further individual sheets.

Suitably, the drive roller and the control member are arranged about parallel axes of rotation. Furthermore, the coupling mechanism may comprise a gear train having at least two gears which mesh with each other when the control member is in the first axial position, such that a manual angular displacement of the control member causes a proportional angular displacement of the drive roller.

According to a second aspect of the present invention there is provided a printer having a facility for manually directing a printing medium along a printing medium path, the printer comprising: a drive roller arranged about an axis of rotation for feeding a printing medium through a processing zone of the printer; a control member comprising an axial shaft with a manually actuable knob at a distal end thereof, the control member arranged about an axis of rotation, and movable between a first axial position and a second axial position; a coupling mechanism selectively coupling the control member and the feed roller to translate rotational movement of the control member into rotational movement of the feed roller, the coupling mechanism being engaged when the control member is in the first axial position and disengaged when the control member is in the second axial position; a picking mechanism coupled to the drive roller, for picking individual sheets of media from a sheet media stack; and a linkage mechanism coupled to the shaft of the control member, such that when the control member is in the first axial position, the linkage mechanism engages with the picking mechanism to disable further picking of sheets.

DETAILED DESCRIPTION OF SPECIFIC EMBODIMENTS OF THE INVENTION

As stated above, the present invention relates generally to feed systems of the type used to advance sheet media along a path. Although the system is described in the context of a single-sheet printer, those skilled will appreciate that the system is similarly useful in a variety of sheet processing machines, whether in a printing, faxing, copying or other applications where it is desired to pass sheets along a sheet media path.

PAPER FEEDING AND JAMMING

Figure 1A:
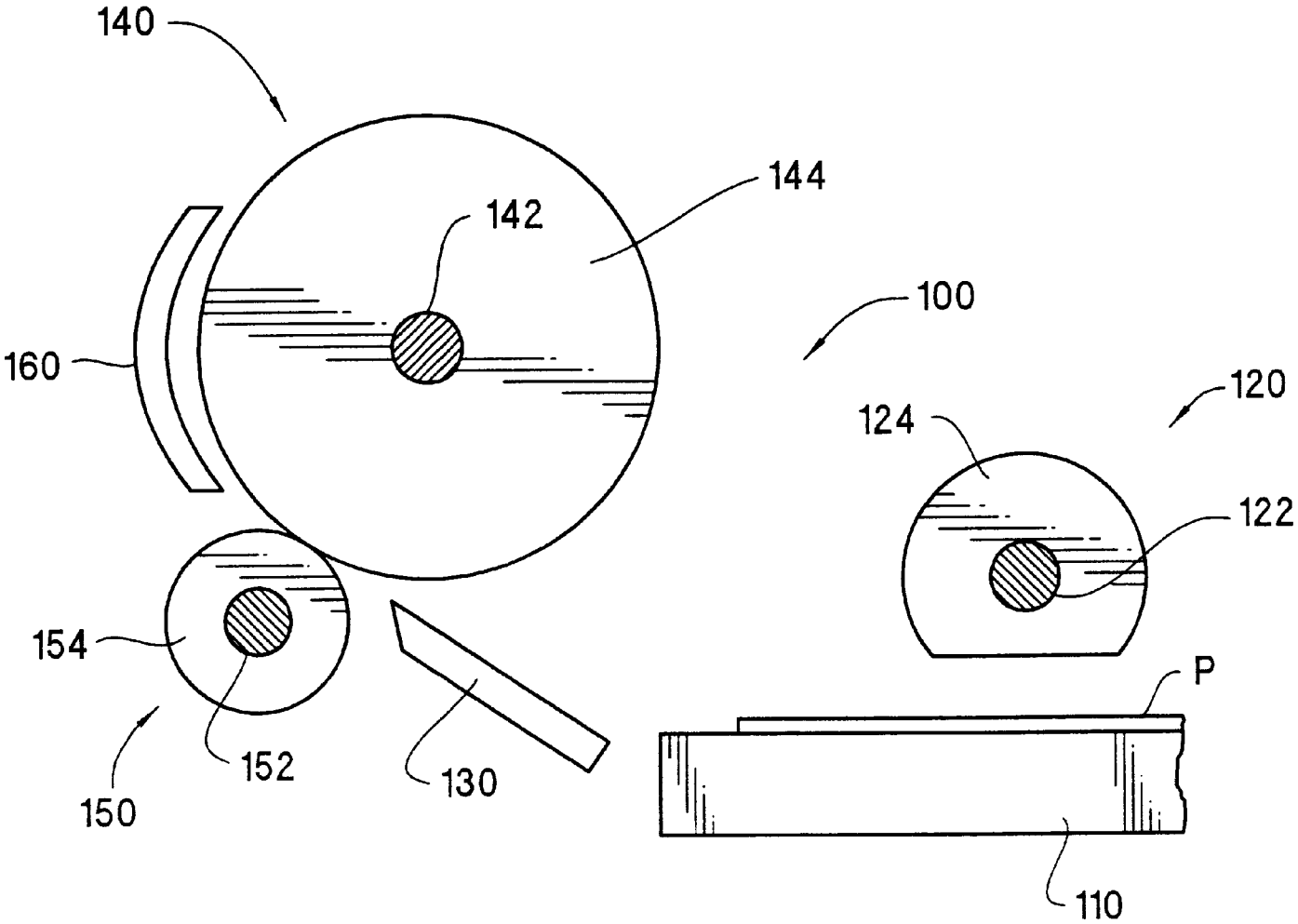
FIG. 1*a* is a schematic diagram of a prior art sheet feeding system, with the picking roller and paper sheets in an initial state.

In FIG. 1*a*, there is shown a simplified schematic drawing of a prior art sheet feeding system 100 comprising, in accordance with the sequence of a feeding operation, an input tray 110 containing a stack of paper sheets P, a pick roller 120, a infeed zone sheet guide 130, a drive roller 140 co-operating with a pinch roller 150, and a processing zone sheet guide 160. Each roller 120, 140, 150 comprises an axially mounted shaft 122, 142, 152 supporting one or more roller members 124, 144, 154 respectively. The shafts 122, 142, 152 are made, for example, from metal such as stainless steel. In contrast, the roller members 124, 144, 154 are formed, for example, from a rubber-like material which gives them a frictionally adherent surface characteristic. The pick roller 120 includes three such roller members 124, each having an annular shape with a asymmetrically flattened external surface, whereas the drive and pinch roller 140, 150 each include a single roller member 144, 154 having a uniform annular shape.

Figure 1B:
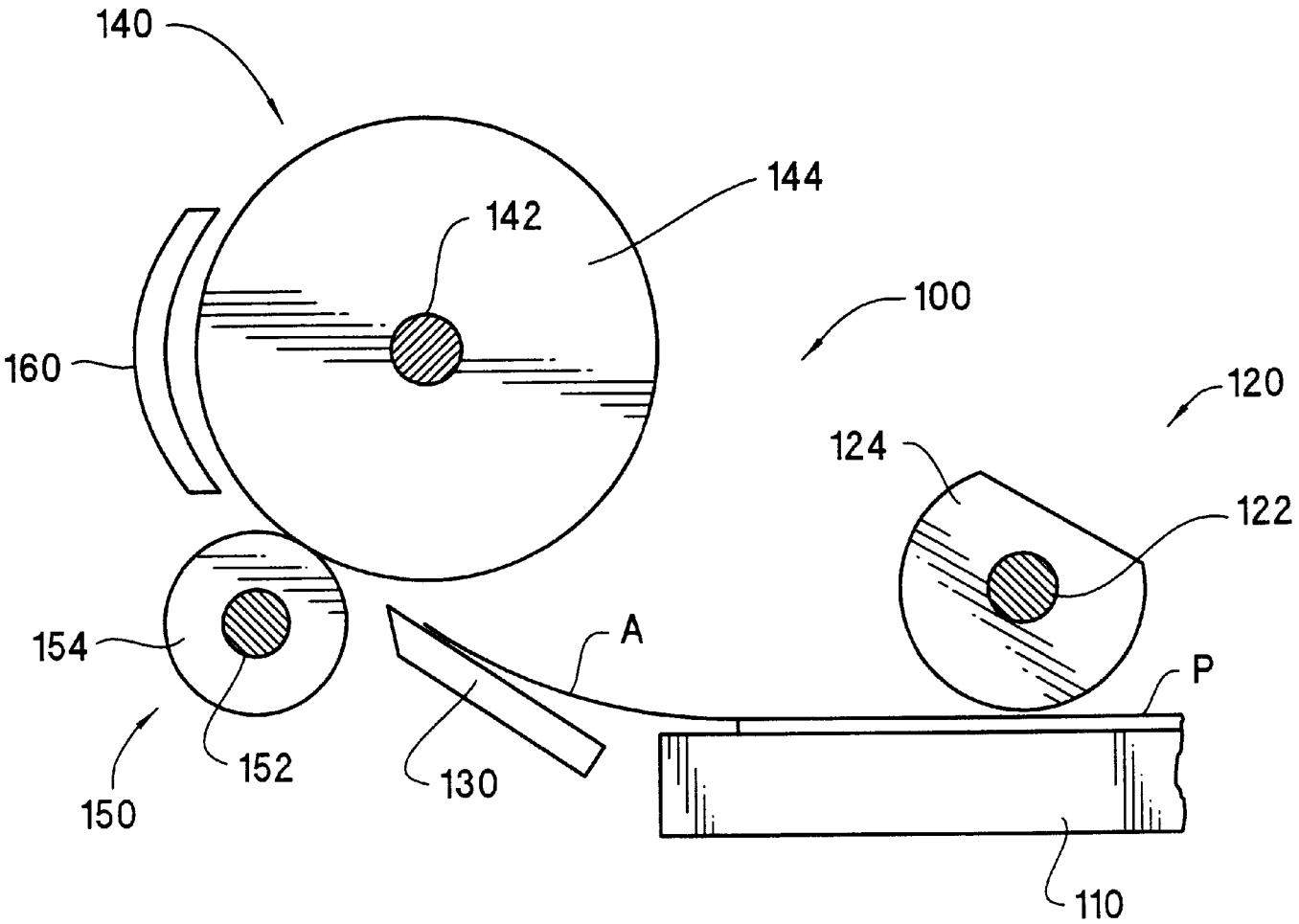
FIG. 1*b* is a schematic diagram similar to that of FIG. 1*a*, but with the picking roller feeding the first (top) paper sheet into the infeed zone.
Figure 1C:
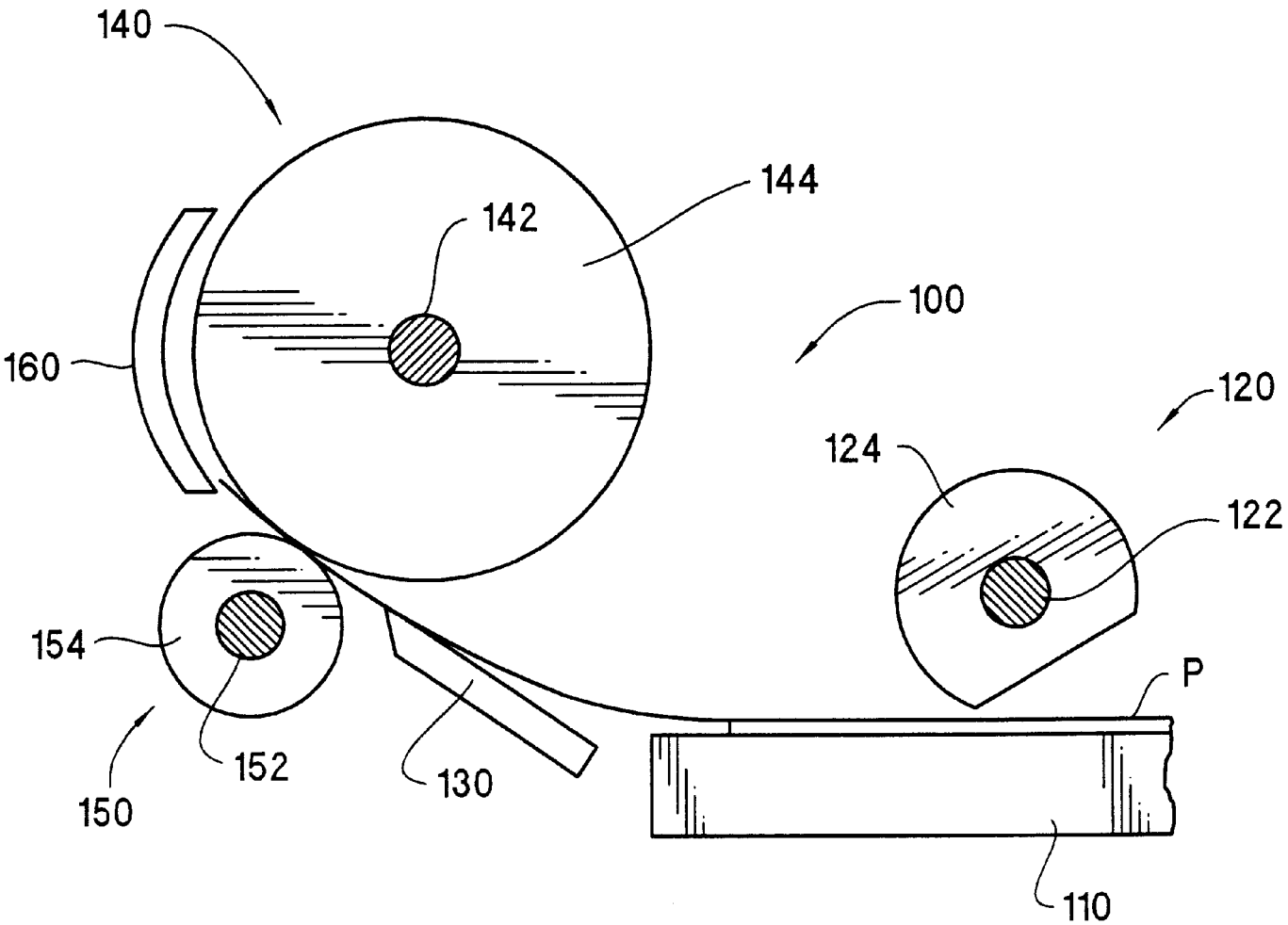
FIG. 1*c* is a schematic diagram similar to that of FIG. 1*b*, but with the picking roller having fed the first paper sheet to the drive roller which it turn is feeding the sheet into the processing zone.

Standard operation and jamming of the sheet feeding system will now be described with reference to FIGS. 1*a*, 1*b*, 1*c*, 1*d*, and 1*e*. Initially, the flattened surfaces of the pick roller members face the stack of paper sheets P as shown in FIG. 1*a*. Rotation of the pick roller members in a clockwise direction causes the leading edge of the curved surface to frictionally contact the top surface of the stack of paper sheets P. Continued rotation of the pick roller causes the first sheet A to be fed into the infeed zone. Here it is guided by the infeed zone guide 130 towards the drive and pinch rollers, as illustrated in FIG. 1*b*. As the trailing edge of the curved surface of each pick roller member rises from the paper surface, the top sheet A will be caught by the pinching action of the drive and pinch rollers. The pinch action results from the drive roller rotating in a clockwise direction against the pinch roller which rotates in an anti-clockwise direction, as illustrated in FIG. 1*c*. The top sheet is then fed by the drive and pinch rollers, with guidance from the processing zone paper guide, into processing zone of the printer.

Figure 1D:
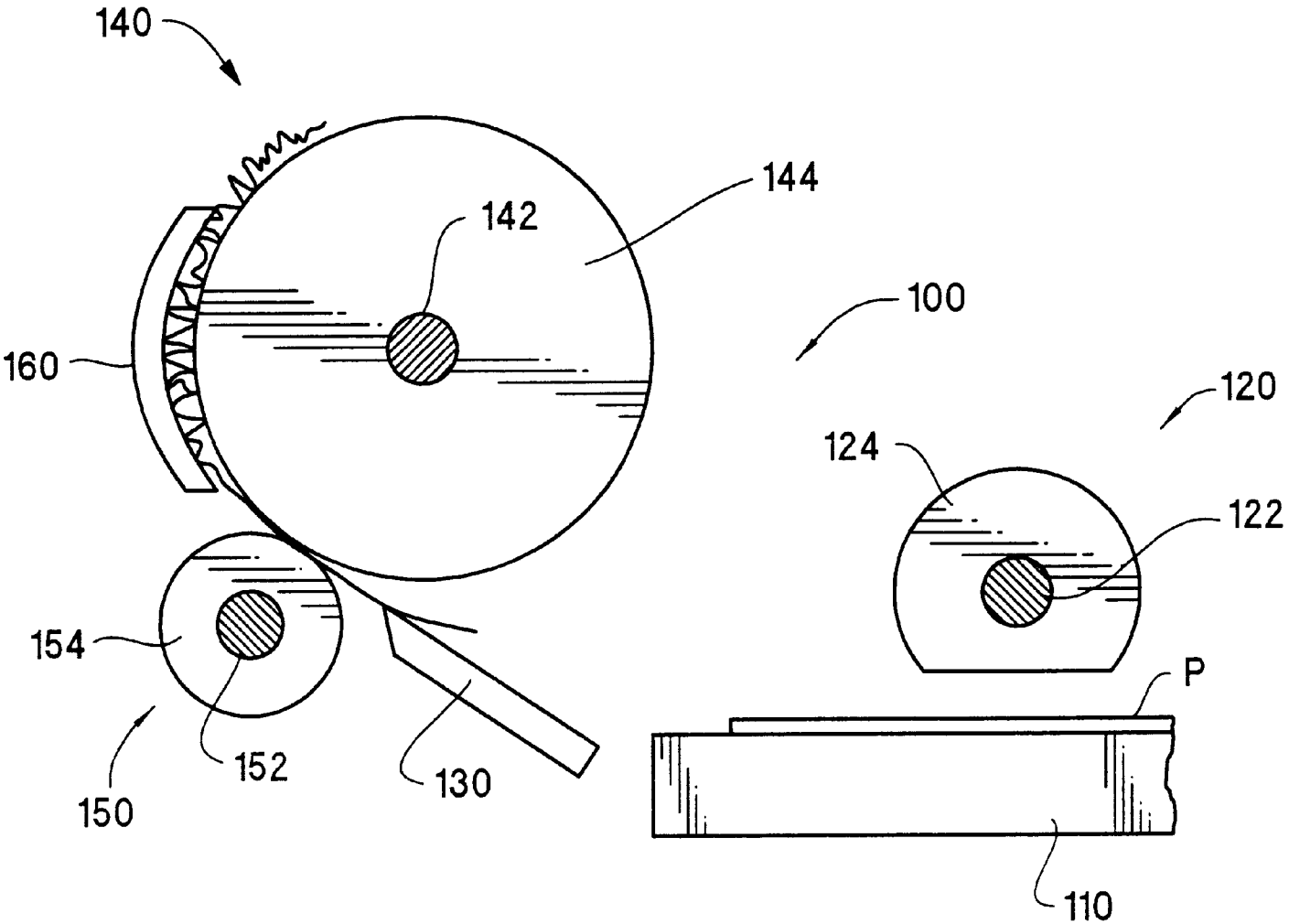
FIG. 1*d* is a schematic diagram similar to that of FIG. 1*c*, but with the picking roller having returned to its initial state and the first paper sheet having become jammed beyond the drive roller.
Figure 1E:
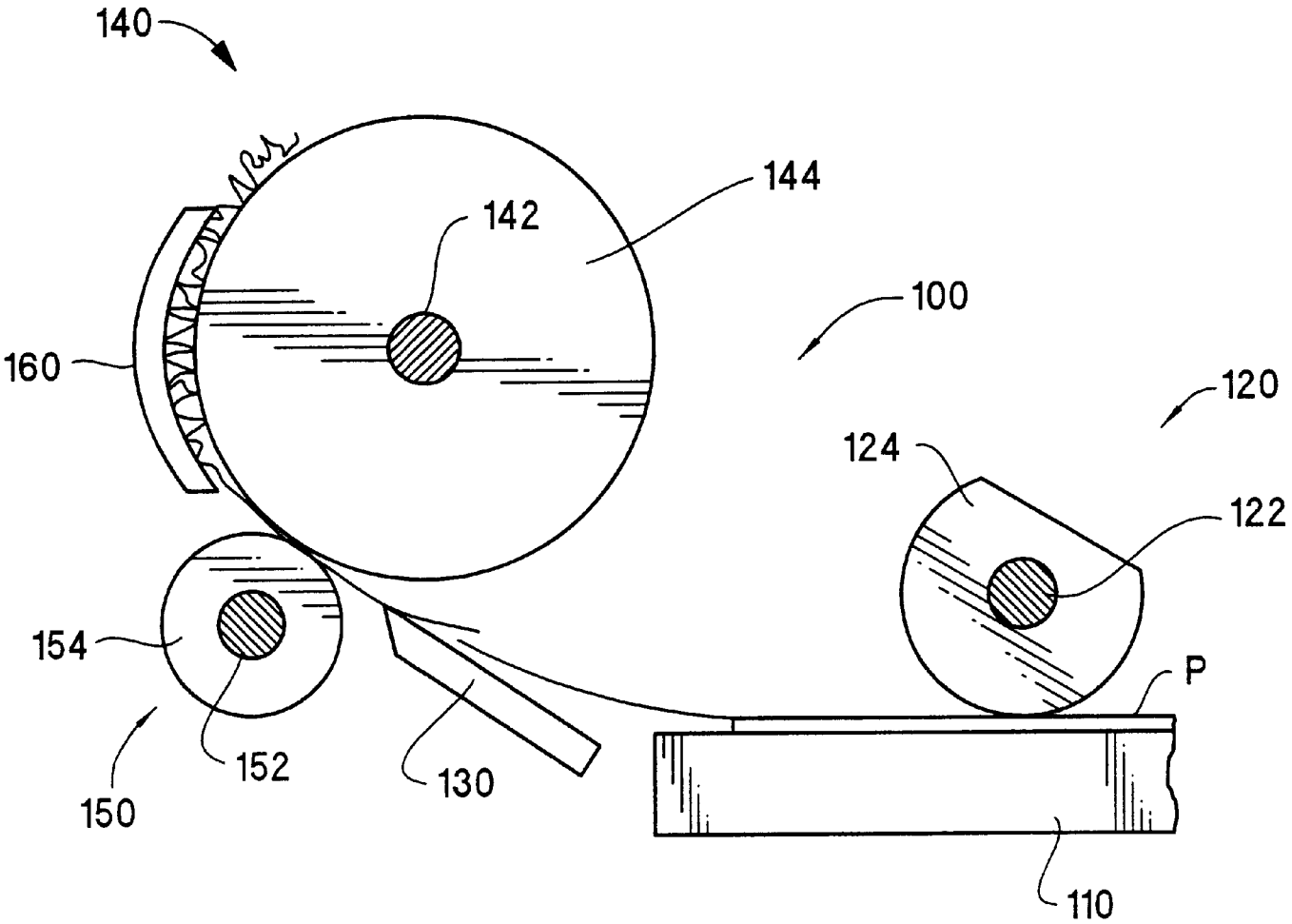
FIG. 1*e* is a schematic diagram similar to that of FIG. 1*d*, but with the picking roller feeding a second (top) paper sheet into the infeed zone and the first paper sheet remaining jammed.

The paper may be stopped by some obstruction in the paper path. Continued feeding of the paper by the drive and pinch rollers will then result in the paper building up behind the obstruction and causing a paper jam, as illustrated in FIG. 1*d*. The pick roller may then be activated to pick another sheet. This second sheet will be fed by the pick roller towards the infeed zone with the first sheet remaining in the jammed state, as illustrated in FIG. 1*e*.

In addition to the illustrated elements, the sheet feeding system also comprises a gear train which permanently couples the drive roller to a drive motor to provide automated control of the sheet feeding system. The pinch roller is mounted so as to be freely rotational. The pinch roller is also biased against the drive roller so that the contact surfaces of the two rollers co-operate, forcing the pinch roller to rotate in an opposite sense to the rotation of the drive roller. The pick roller forms part of a picking mechanism which selectively couples to the drive roller so that the sheet picking operation can be selectively activated. One such picking mechanism is the prior art reverse picking mechanism referred to in the introduction.

REVERSE PICKING MECHANISM

The reverse picking mechanism used in the Hewlett-Packard DeskJet 1100C sheet feed printer will now be described with reference to FIGS. 2*a*, 2*b*, 3*a*, 3*b*, 4*a*, 4*b*, and 4*c*.

Figure 2B:
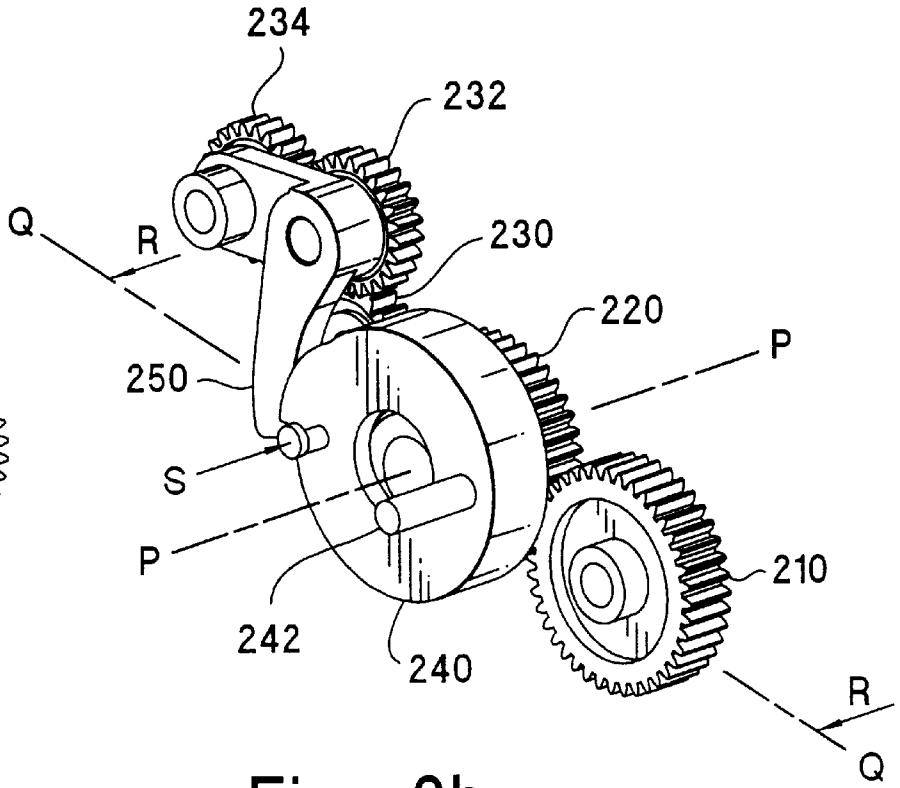
FIG. 2*b* is an isometric view of the gear and clutch arrangement of FIG. 2*a*.
Figure 2A:
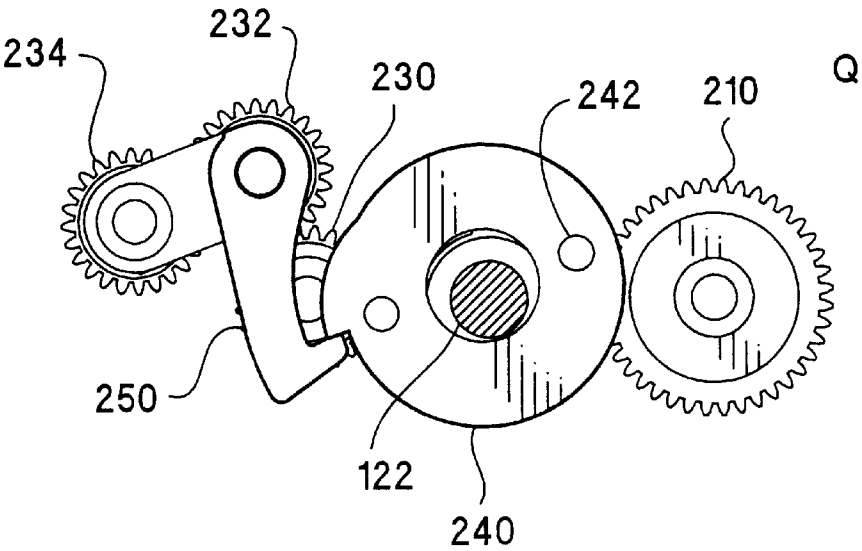
FIG. 2*a* is a side view of a prior art gear and clutch arrangement for selectively coupling the drive roller to the pick roller, shown in the decoupled state.

In FIGS. 2*a* and 2*b*, there is shown a gear and clutch arrangement 200 viewed from an opposite direction to the side view of FIG. 1*a*. The arrangement 200 comprises a set of gear wheels 210, 220, 230, 232, and 234 arranged on parallel axes and linked in series with each other. The gear wheel 210 rotates about a fixed axis and is coupled indirectly to the drive shaft 142 of the drive roller 140. Rotation of the drive roller 140 is translated via a gear train into opposite rotation of the gear wheel 210. The gear wheel 220 is freely mounted for independent rotation on the pick shaft 122. The pick shaft 122 is shown in cross-section in FIG. 2*a*, and defines the axis P-P in FIG. 2*b*. The gear wheel 230 rotates about a fixed axis and is directly coupled to the gear wheel 220 and the gear wheel 232.

The arrangement further comprises a clutch member 240 and an activating lever 250. The clutch member is mounted for rotation about a movable axis defined by the finger portion 242, as will be described in further detail. The activating lever 250 and the gear wheel 232 are mounted on a common fixed axis and are independently rotatable. The gear wheel 234 is mounted for rotation about a movable axis associated with an arm of the activating lever 250. The rotational mounting is of the frictional type which resists, but does not prevent, rotation of the gear wheel 234.

The gear and clutch arrangement is shown in FIGS. 2*a* and 2*b* in the disengaged or declutched state. This corresponds to the picking mechanism not being activated, as illustrated originally in FIGS. 1*a* and 1*d*.

Figure 3A:
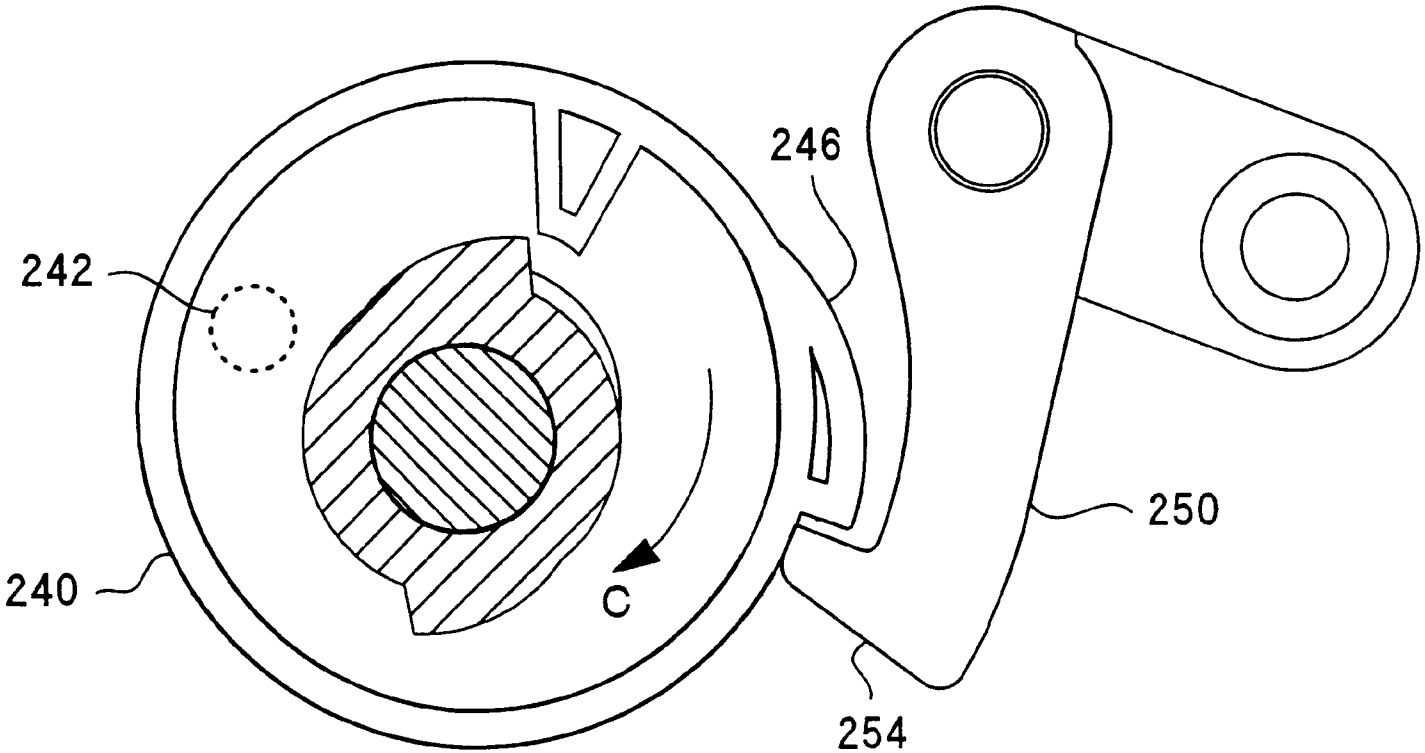
FIG. 3*a* is a cross-sectional view of the gear and clutch arrangement of FIG. 2*a* showing the clutch disengaged.
Figure 3B:
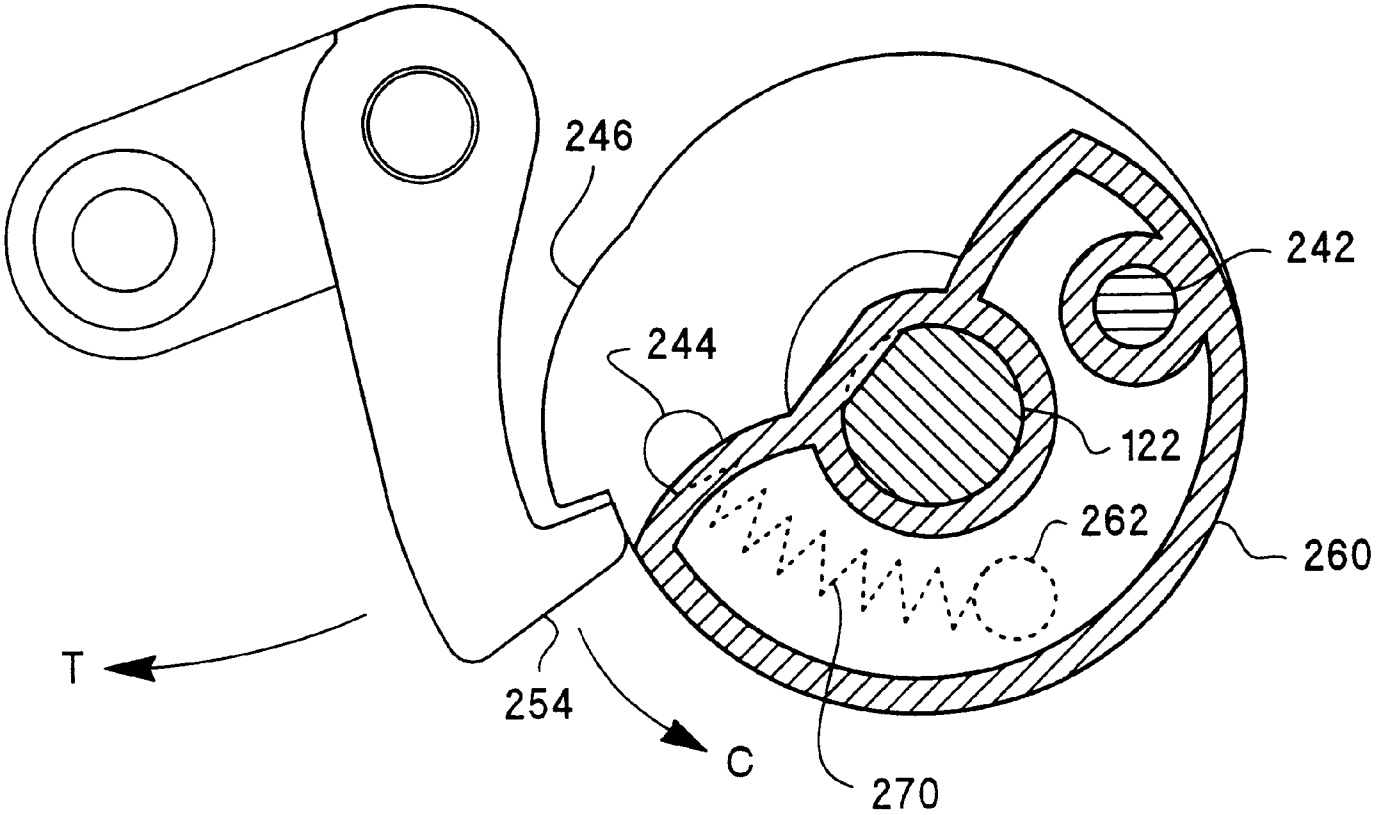
FIG. 3*b* is a cross-sectional similar to that of FIG. 3*a*, but from a reverse angle.

Further reference is now made to FIGS. 3*a* and 3*b*, which show in greater detail the clutch of the gear and clutch arrangement 200. FIG. 3*a* is a cross-sectional view of the clutch of FIG. 2*b* in the direction of arrows R, whereas FIG. 3*b* is a cross-sectional view of the clutch of FIG. 2*b* in the direction of the arrow S. FIG. 3*b* shows in addition a clutch support 260 of the gear and clutch arrangement 200 which is fixedly mounted to the pick shaft 122. The clutch support 260 has an aperture which receives the finger portion 242 of the clutch member 240, allowing the clutch member to rotate about the central axis of the finger portion 242. FIG. 3*a* shows the clutch member 240 with a hollowed out interior, and a portion of the gear wheel 220 freely mounted on the pick shaft 122 for rotation within the clutch member interior.

In the declutched state, a catch portion 254 of the activating lever 250 is engaged with a barb portion 246 of the clutch member 240. A spring 270 connected between a peg 262 on the clutch support and a peg 244 on the clutch member 240 biases the barb portion 246 against the catch portion 254.

Figure 4B:
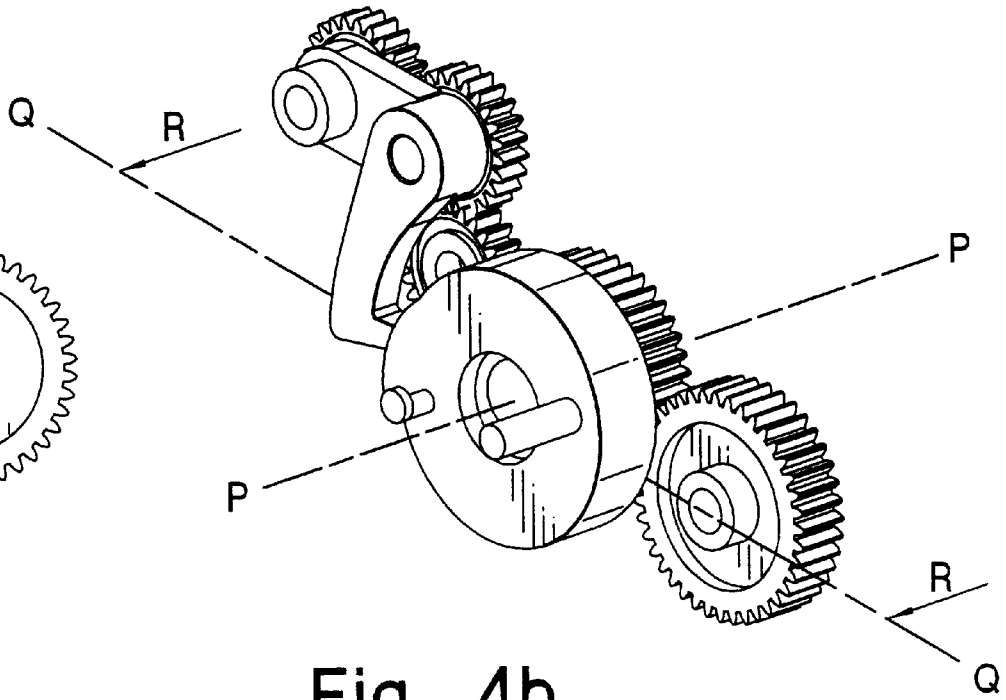
FIG. 4*b* is isometric view of the gear and clutch arrangement of FIG. 2*a*, also shown in the coupled state.
Figure 4A:
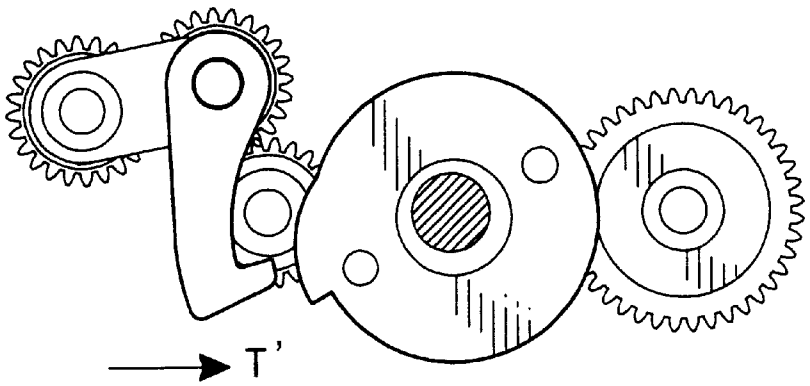
FIG. 4*a* is side view of the gear and clutch arrangement of FIG. 2*a*, shown in the coupled state.
Figure 5:
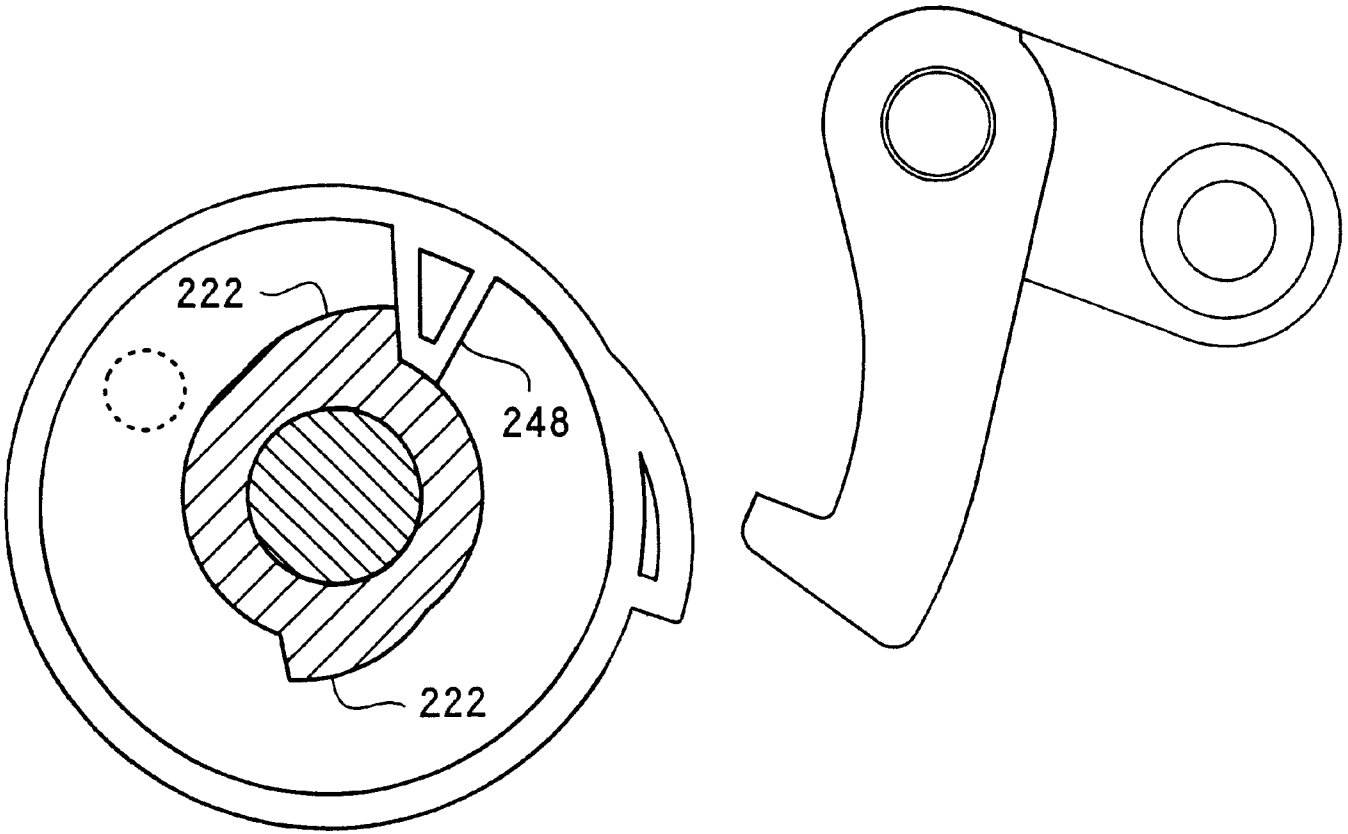
FIG. 5 is a cross-sectional view of the gear and clutch arrangement of FIG. 2*a*, showing the clutch engaged.

To activate or initiate the picking mechanism, the printer instructs the drive motor to briefly rotate the drive roller in the reverse feed direction (anti-clockwise in FIGS. 1*a* and 1*d*). This causes the gear wheels 210, 230, and 234 to rotate in the anti-clockwise direction (in FIGS. 2*a* and 2*b*), and the gear wheels 220 and 232 to rotate in the clockwise direction. The frictional mounting of the gear wheel 234 generates a anti-clockwise drag torque opposing the clockwise motion of the wheel. The torque is translated to the lever 232 and urges the lever in the direction of arrow T. The torque is sufficient to overcome the force of the spring 270 to release the catch portion 254 from the barb 246. The gear and clutch mechanism is now in the engaged or clutched state, as shown in FIGS. 4*a*, 4*b* and 5.

As shown in FIGS. 3*a* and 3*b*, release of the catch portion 254 from the barb 246 causes the clutch member to rotate under the force of the spring 270 about the finger portion 242. The direction of motion is indicated by the arrow C. After rotation, the clutch member becomes seated in the clutched position shown in FIG. 5. In this position, an inwardly directed tooth portion 248 of the clutch member 240 abuts one of two diametrically opposed shoulder portions 222 of the gear wheel 220.

Once the reverse motion of the drive roller has clutched the picking mechanism, the printer instructs the drive motor to rotate the drive roller in the forward direction (clockwise in FIGS. 1*a* and 1*d*). This causes the gear wheels 210, 230, and 234 to rotate in the clockwise direction (in FIGS. 4*a* and 4*b*), and the gear wheels 220 and 232 to rotate in the anti-clockwise direction. The frictional mounting of the gear wheel 234 now generates a clockwise drag torque opposing the anti-clockwise motion of the wheel. The torque is translated to the lever 232 and urges the lever back in the direction 20 of arrow T' until the catch portion rests against the outer surface of the barb portion.

Meanwhile, rotation of the gear wheel 220 (clockwise in FIG. 5) forces the shoulder portion 222 against the tooth portion 248 of the clutch member 240. The clutch member in turn forces the clutch support via the finger portion 242, which in turn forces the shaft 122. Thus, rotation of the gear wheel 220 causes corresponding rotation of the shaft 122 and the pick roller members to pick a single sheet from the sheet stack.

During rotation of the clutch member, the catch portion of the lever 250 is cammed against the outer surface of the clutch member. After almost one rotation of the clutch member, the barb portion of the clutch member catches on the catch portion of the lever 250. Continued rotation of the gear wheel 220 forces the clutch member and the barb portion against the catch portion, lifting the clutch member out of the clutched state. Thus, having completed a single sheet pick, the gear and clutch arrangement once more returns to the declutched state, as shown in FIGS. 2*a*, 2*b*, 3*a* and 3*b*.

CONTROL MEMBER AND COUPLING MECHANISM

Sometimes, it may be desirable to feed paper by means of the drive roller without having to operate the printer drive motor. Such times may include when paper is jammed in the printer as shown in FIGS. 1*d* and 1*e*, or when the drive motor fails. The following describes a system for enabling feeding of paper manually in accordance with the invention.

In FIGS. 6*a*, 6*b*, 7*a* and 7*b*, there is shown a control member and part of a coupling mechanism. The control member comprises a knob 610 attached to a shaft 620. The shaft is mounted to allow rotation of the control member about an axis as indicated by the arrow R in FIG. 7*a*. The shaft mounting also allows axial movement of the control member between the position shown in FIGS. 6*a* and 6*b*, and the position shown in FIGS. 7*a* and 7*b*. The shaft is also mounted so that it is biased towards the position shown in FIGS. 6*a* and 6*b*. This can be implemented in various known ways, for example, by means of a spring or an elastic band arrangement.

The coupling mechanism comprises a first gear wheel 710 located on the shaft 620 of the control member, and a second gear wheel 720 indirectly coupled via a gear train to the drive roller.

Figure 6A:
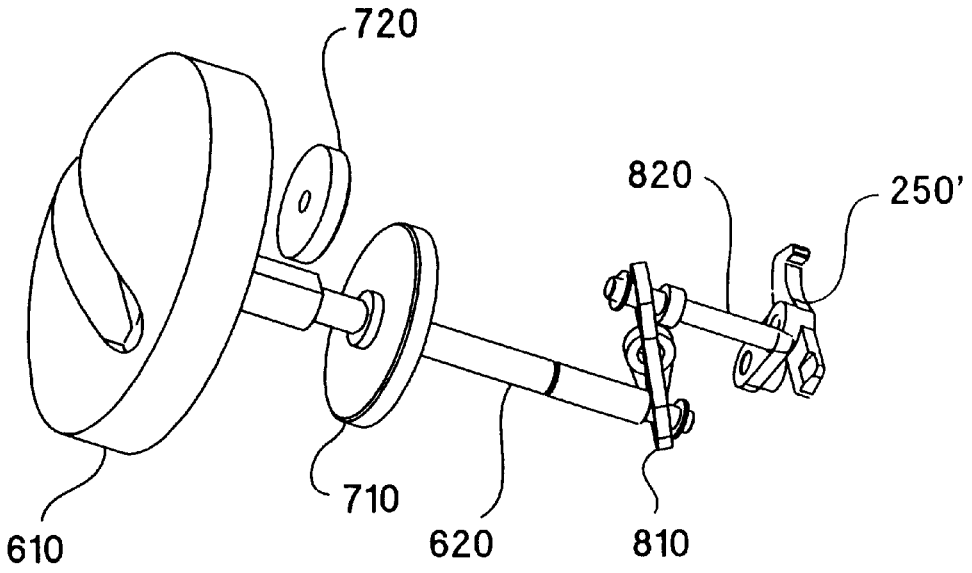
FIG. 6*a* is a perspective view of a control member and a linkage mechanism in accordance with the invention, with the control member in the retracted position.
Figure 6B:
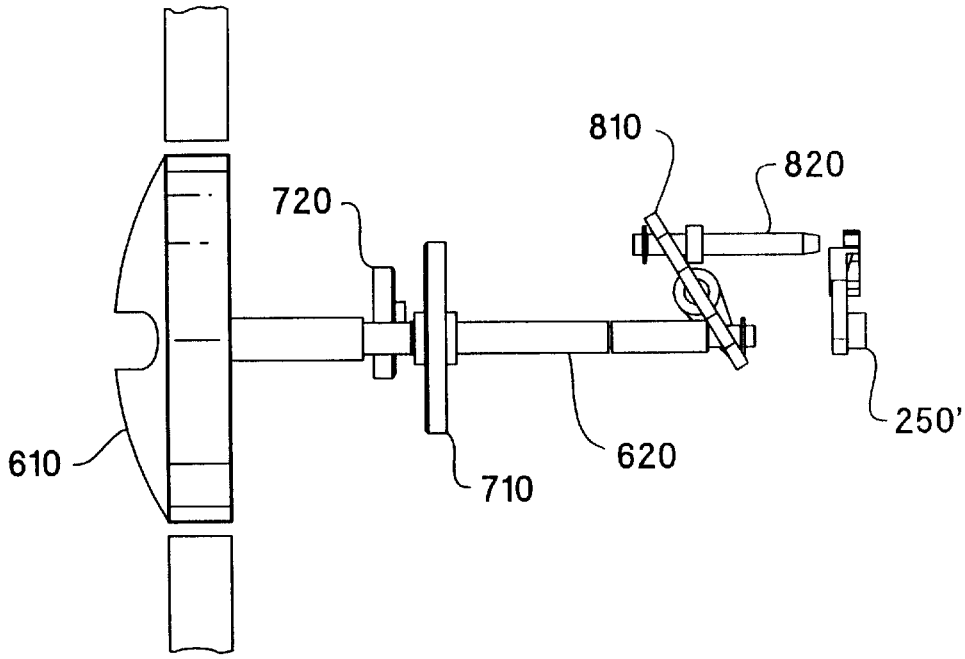
FIG. 6*b* is a side view of the control member and linkage member of FIG. 6*a*, with the control member shown flush with the external housing of the printer.

The control member is shown in FIGS. 6*a* and 6*b* in the disengaged axial position. In this position there is no interaction between the first gear wheel 710 and the second gear wheel 720 of the coupling mechanism. The coupling mechanism is therefore disengaged. Any rotation of the knob 610 will not feed any paper present in the paper feed path.

Figure 7A:
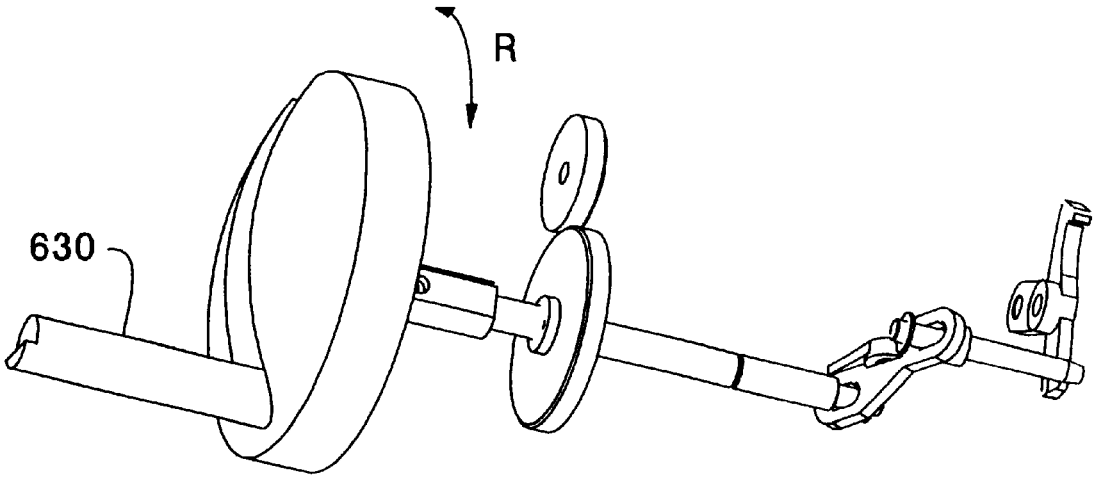
FIG. 7*a* is a perspective view of the control member and linkage mechanism of FIG. 6*a*, with the control mechanism in the extended position.
Figure 7B:
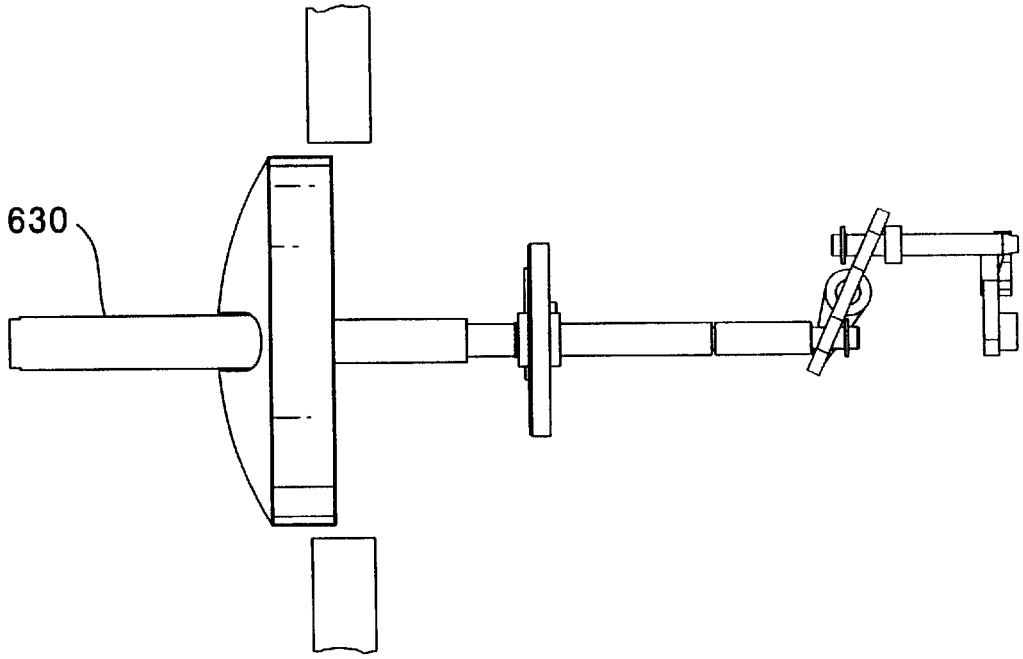
FIG. 7*b* is a side view of the control member and linkage mechanism of FIG. 7*a*, with the control member shown protruding from the external housing of the printer.
Figure 8B:
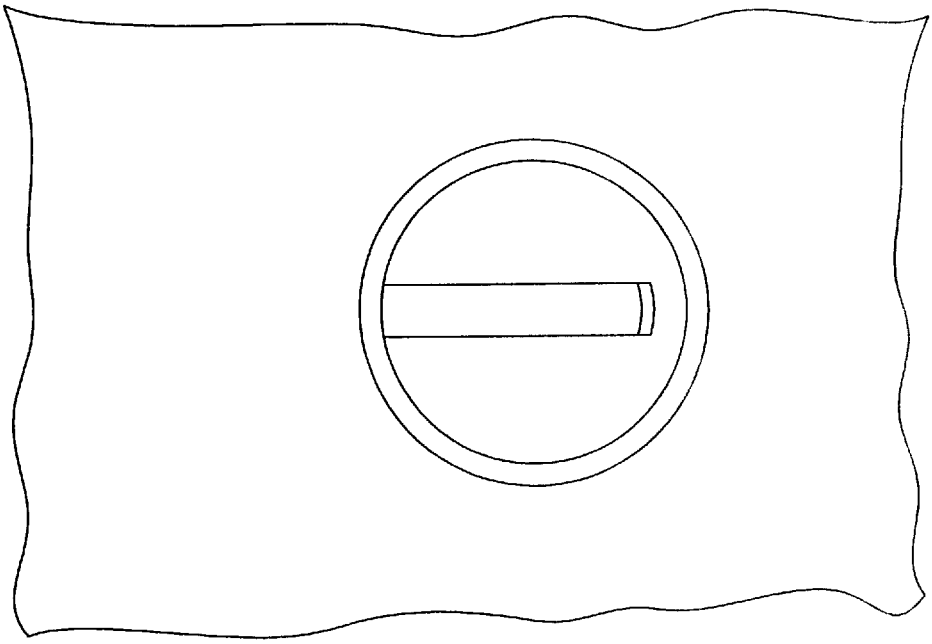
FIG. 8*b* is a cross-sectional view of FIG. 8*a* along line A—A, showing the control member flush with the external housing of the printer.
Figure 8A:
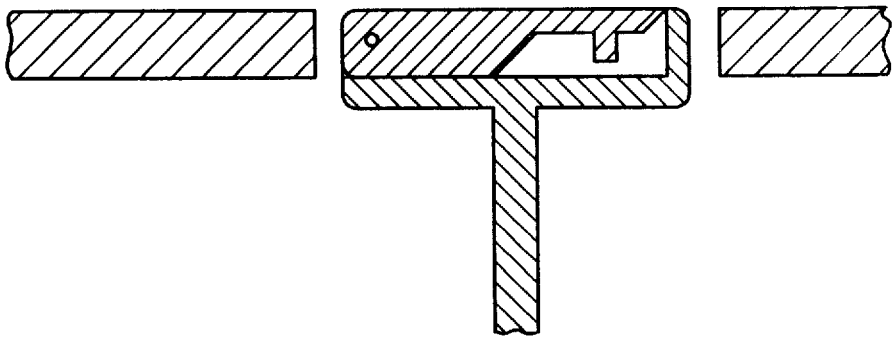
FIG. 8*a* is a partial view of the external housing of the printer showing an alternative control member in accordance with the invention in the retracted position.
Figure 9B:
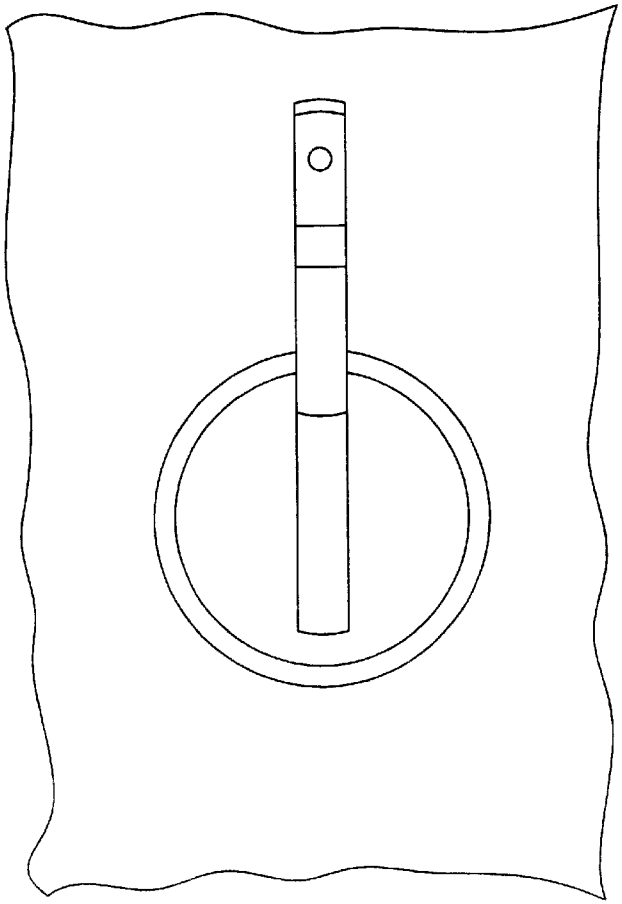
FIG. 9*b* is a cross-sectional view of FIG. 9*a* along line A—A, showing the control member protruding from the external housing of the printer.
Figure 9A:
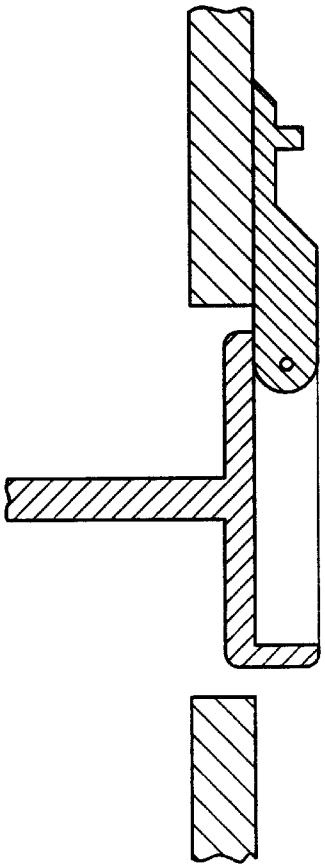
FIG. 9*a* is a partial view similar to that of FIG. 8*a*, but with the control member in the extended position.

In FIGS. 7*a* and 7*b*, the control member is shown in the engaged axial position. In this position the first gear wheel 710 meshes with the second gear wheel 720 of the coupling mechanism. The coupling mechanism is therefore engaged. Manual rotation of the knob by a user will direct paper adjacent the drive roller towards either the infeed zone or the output zone. To assist a user in continually rotating the control member, the knob 610 includes a lever 630 attached at a proximal end to a hinge in the knob. The lever may be extended and grasped at a distal end to rotate the knob 610. FIG. 7*a* and 7*b* shows the lever extended with the distal end having a independently rotatable portion to further assist manual rotation.

In FIGS. 6*b* and 7*b*, the relative position of the printer housing and the knob 610 of the control member is shown for the disengaged and engaged states respectively. In the disengaged state, the knob is flush with the external housing of the printer so that the external dimensions of the printer are minimised. In the engaged state, the knob 610 and the lever 630 protrude from the printer housing increasing the printers external dimensions. Because the engaged state is only used occasionally, the default state of the systems provides the manually operable knob flush with the printer housing. The knob is therefore less likely to be damaged during normal operation. Biasing of the control member to the disengaged state also has a number of benefits. For example, the biasing will automatically return the control member to the disengaged position after manual engagement. Also, the control member will be less likely to engage unless engagement is manually intended.

In FIGS. 8*a*, 8*b*, 9*a* and 9*b*, there is shown an alternative knob of the control member. In this embodiment, movement of the lever from the retracted position shown in FIG. 8*a* to the extended position shown in FIG. 9*a* forces the control member to the engaged position. The force is produced by the proximal end of the lever urging against the edge of the printer housing. To operate in the extended position, a user rotates the distal end of the lever whilst at the same time pressing the lever against the printer housing to maintain engagement. Once operation is complete, a user can let go of the lever. The return biasing of the control member to the disengaged position will flick the lever back to the flush retracted position shown in FIG. 8*a*.

LINKAGE MECHANISM

If jammed paper needs to be removed from the sheet feed path such as in the situation shown in FIGS. 1*d* and 1*e*, it is desirable to prevent further sheets being picked and fed. The following describes a system in accordance with the invention for disabling the reverse picking mechanism.

Figure 10B:
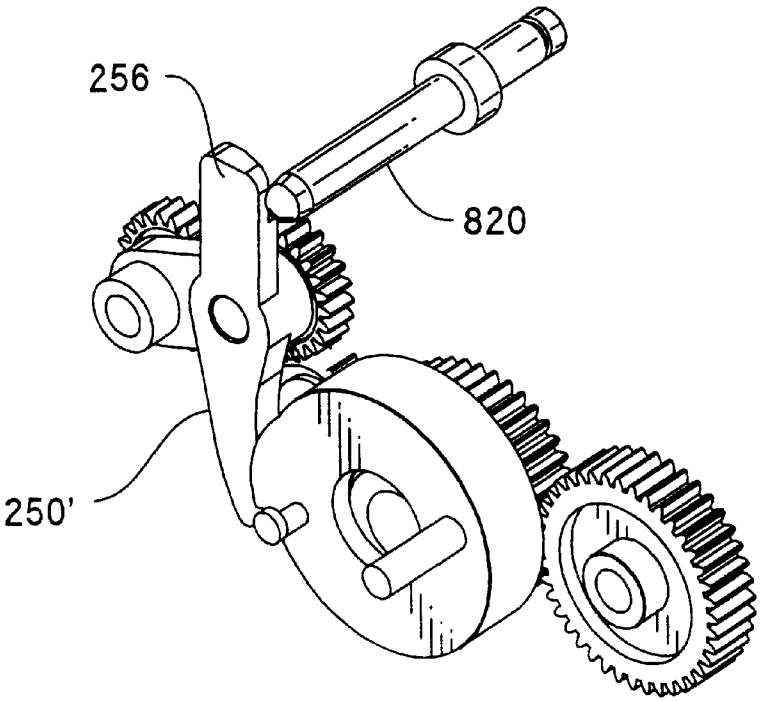
FIG. 10*b* is an isometric view of the gear and clutch arrangement of FIG. 10*a*.
Figure 10A:
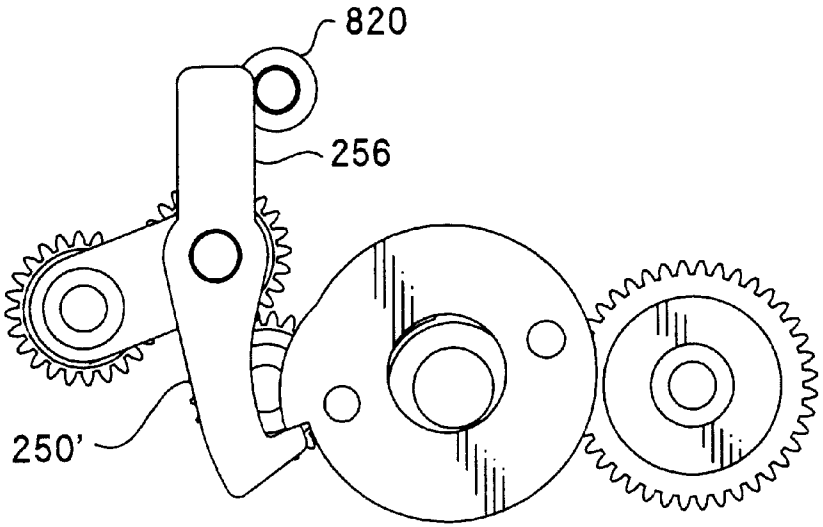
FIG. 10*a* is a side view of the gear and clutch arrangement of FIG. 2*a*, modified in accordance with the invention to include an engagable flange portion.

Referring back to the embodiment of FIGS. 7*a*, 7*b*, 8*a*, and 8*b*, there is shown a linkage mechanism comprising a lever 810 and a shaft 820. The lever 810 is pivotally mounted at its centre, and is connected at one end to the shaft 620 of the control member, and at the other end to the shaft 810 of the linkage mechanism. The lever couples the two shafts so that axial movement of one shaft produces corresponding axial movement of the other shaft in the opposite direction. FIGS. 7*a*, 7*b*, 8*a*, and 8*b* also show the lever 250' of the gear and clutch mechanism modified in accordance with the invention. This lever is shown in more detail in FIGS. 10*a* and 10*b*, and includes an additional flange portion 256 for interacting with the shaft linkage mechanism.

When the control member is in the disengaged position, as shown in FIGS. 6*a* and 6*b*, there is no interaction between the shaft of the linkage mechanism and the lever of the picking mechanism. Consequently, operation of the printer feeding system including sheet picking may proceed as normal.

When the control member is moved to the engaged position, the lever of the linkage mechanism acts to translate axial movement of the shaft 620 into opposite axial movement of the shaft 820. Once the coupling mechanism is engaged, the shaft 820 will have moved to the position shown in FIGS. 7*a*, 7*b*, 10*a* and 10*b*, in which it interacts or engages with the lever of the picking mechanism.

In one situation, the control member may be moved to the engaged position in order to remove a paper jam such as the type shown in FIG. 1*d*. In this case, the gear and clutch mechanism will be in the declutched state. Engagement of the picking mechanism lever will have the effect of maintaining the gear and clutch mechanism in the declutched state. Reverse manual driving of the drive roller will not therefore result in any further sheets being picked from the sheet stack. Consequently, the reverse picking mechanism will be temporarily disabled.

In another situation, the control member may be moved to the engaged position in order to remove a paper jam such as the type shown in FIG. 1*e*. In this case, the gear and clutch mechanism will be in the clutched state. Engagement of the picking mechanism lever will have the effect of urging the lever against the outer surface of the gear and clutch mechanism. The partially picked sheet will continue to be fed dependent on the manual driving until the clutch member is caught by the catch of the lever. The picking mechanism will then declutch and will remain declutched as long as the control member is engaged. Consequently, reverse manual driving of the drive roller will again not result in any further sheets being picked from the sheet stack.

What is claimed is:

1. A printer having a facility for manually directing a printing medium along a printing medium path, the printer comprising:

an external housing;

a drive roller arranged about an axis of rotation for feeding a printing medium through a processing zone of the printer;

a control member arranged about an axis of rotation, and movable between a first axial position in which the control member protrudes from said external housing so as to be manually actuable, and a second axial position in which the control member is retracted relative to the first axial position;

a linkage mechanism coupled to the control member, such that when the control member is in the first axial position, the linkage mechanism stops further feeding of individual media into the printer; and a coupling mechanism selectively coupling the control member and the drive roller to translate rotational movement of the control member into rotational movement of the drive roller, said coupling mechanism being engaged when the control member is in the first axial position and disengaged when the control member is in the second axial position.

2. A printer as claimed in claim 1, wherein the control member is biased towards the second axial position.

3. A printer as claimed in claim 1, wherein the control member is substantially flush with the external housing in the second axial position.

4. A printer as claimed in claim 1, wherein the control member comprises an axial shaft with a manually actuable knob at a distal end thereof.

5. A printer as claimed in claim 4, wherein the knob includes a hinge supporting a lever, which lever may be extended to aid movement of the control member from the second axial position to the first axial position, and to aid continuous manual rotation of the knob.

6. A printer as claimed in claim 4, wherein the printer further comprises;

A picking mechanism selectively coupled to the drive roller, for picking individual sheets of media from a sheet media stack; and wherein the linkage mechanism is coupled to the shaft of the control member, such that when the control member is in the first axial position, the linkage mechanism engages with the picking mechanism to disable picking of further individual sheets.

7. A printer as claimed in claim 6, wherein the linkage member comprises a shaft arranged in parallel with the control member shaft, and a pivotally mounted lever attached to both the control member shaft and the linkage member shaft, the lever translating axial movement of the control member shaft in one direction into axial movement of the linkage mechanism shaft in an opposite direction, whereby movement of the control member to the first axial position causes movement of the linkage mechanism shaft in a direction so as to engage with the picking mechanism to disable further picking of further individual sheets.

8. A printer as claimed in claim 1, wherein the drive roller and the control member are arranged about parallel axes of rotation.

9. A printer as claimed in claim 1, wherein the coupling mechanism comprises a gear train having at least two gears which mesh with each other when the control member is in the first axial position such that a manual angular displacement of the control member causes a proportional angular displacement of the drive roller.

10. A printer having a facility for manually directing a printing medium along a printing medium path, the printer comprising:

a drive roller arranged about an axis of rotation for feeding a printing medium through a processing zone of the printer;

a control member comprising an axial shaft with a manually actuable knob at a distal end thereof, the control member arranged about an axis of rotation, and movable between a first axial position and a second axial position;

a coupling mechanism selectively coupling the control member and the feed roller to translate rotational movement of the control member into rotational movement of the feed roller, the coupling mechanism being engaged when the control member is in the first axial position and disengaged when the control member is in the second axial position;

a picking mechanism coupled to the drive roller, for picking individual sheets of media from a sheet media stack; and a linkage mechanism coupled to the shaft of the control member, such that when the control member is in the first axial position, the linkage mechanism engages with the picking mechanism to disable further picking of sheets.

11. A printer as claimed in claim 10, wherein the linkage member comprises a shaft arranged in parallel with the control member shaft, and a pivotally mounted lever attached to both the control member shaft and the linkage member shaft, the lever translating axial movement of the control member shaft in one direction into axial movement of the linkage mechanism shaft in an opposite direction, whereby movement of the control member to the first axial position causes movement of the linkage mechanism shaft in a direction to engage with the picking mechanism to disable further picking of sheets.

* * * * *